United States Patent [19]

Sheu

[11] Patent Number: 4,554,997

[45] Date of Patent: Nov. 26, 1985

[54] EMERGENCY DESCENT DEVICE

[76] Inventor: Por-Jiy Sheu, No. 111, Chien-Chen La., Chien-Chen District, Kaohsiung, Taiwan

[21] Appl. No.: 709,211

[22] Filed: Mar. 7, 1985

[51] Int. Cl.[4] ..... A62B 1/12; A62B 1/16

[52] U.S. Cl. ..... 182/238; 182/233; 182/241; 188/290; 254/377

[58] Field of Search ..... 182/233, 238, 75, 71, 182/241; 254/377; 188/290, 268

[56] References Cited

U.S. PATENT DOCUMENTS

| | | | |
|---|---|---|---|
| 1,200,198 | 10/1916 | Jersild | 182/238 |
| 3,847,377 | 11/1974 | Byrd | 254/377 |
| 3,946,989 | 3/1976 | Tsuda | 182/241 |
| 4,018,423 | 4/1977 | Belew | 182/238 |
| 4,416,351 | 11/1983 | Geurtsen | 182/233 |
| 4,452,430 | 6/1984 | Kankkunen | 182/238 |
| 4,463,830 | 8/1984 | Geurtsen | 182/233 |
| 4,480,716 | 11/1984 | Soubry | 182/233 |

*Primary Examiner*—Reinaldo P. Machado

*Attorney, Agent, or Firm*—Shlesinger, Arkwright, Garvey & Fado

[57] ABSTRACT

An improved descent device including a rotating spool on which is wound a cable is provided with a fluid rotation-retarding means having a plurality of vane members mounted for rotation in a fluid-filled chamber. The vane member is comprised of a vane shell receiving a vane core which is normally biassed in a radially inward direction and is extensible from the vane shell by centrifugal force. The retarding force depends on the contact surfaces between the vane members and the fluid which vary with centrifugal force.

4 Claims, 4 Drawing Figures

EMERGENCY DESCENT DEVICE

BACKGROUND OF THE INVENTION

This invention relates to an emergency descent device and particularly to one having a fluid rotation-retarding device for controlling the rate of the descent.

Emergency descent devices having a rotating spool with a cable wound thereon and a fluid rotation-retarding means are known in prior arts. U.S. Pat. Nos. 4,018,423, 3,847,377 and 3,946,989 discloses descent devices having fluid rotation-retarding units which include one or more vane members deviding a fluid-filled, sealed housing into two or more volume variable chambers which are then communicated by providing one or more passages. These passages are adjustable to control the rotating rate of the vane. However, the adjustment of the passage is usually done manually.

SUMMARY OF THE INVENTION

An object of the invention is to provide an emergency descent device with a simplified construction and a self-adjusting fluid rotation-retarding means.

Another object of the invention is to provide an emergency descent device with an improved mounting means by which the device can be mounted easily and firmly on any desired structure.

These and other objects can be achieved in accordance with the invention through the provision of an emergency descent device comprising a rotating spool on which is wound a cable to hold a person or a load, and a rotation-retarding means for controlling the rotation of the spool. The retarding means includes a fluid-filled chamber, a plurality of vane members mounted for rotation in the chamber, each of the vane members having a vane shell receiving a vane core which is normally biassed in a radially inward direction. The vane core is capable of extending outward from the vane shell by a centrifugal force to provide more vane surface to act on the fluid. A gear assembly is further provided which transmits the motion of the spool to the vane members with a high speed ratio.

The mounting means of the descent device is in the form of a hook and includes a horizontal portion and a vertically, downwardly extending portion. The horizontal portion is extensible and the vertically extending portion is provided with engaging teeth to provide an effective engagement with the surface of the structure on which the descent device is mounted.

The present exemplary preferred embodiment will be described in detail with reference to the accompanying drawings, in which:

DETAILED DESCRIPTION OF THE PREFERRED EMBODIMENT

Figure 1:
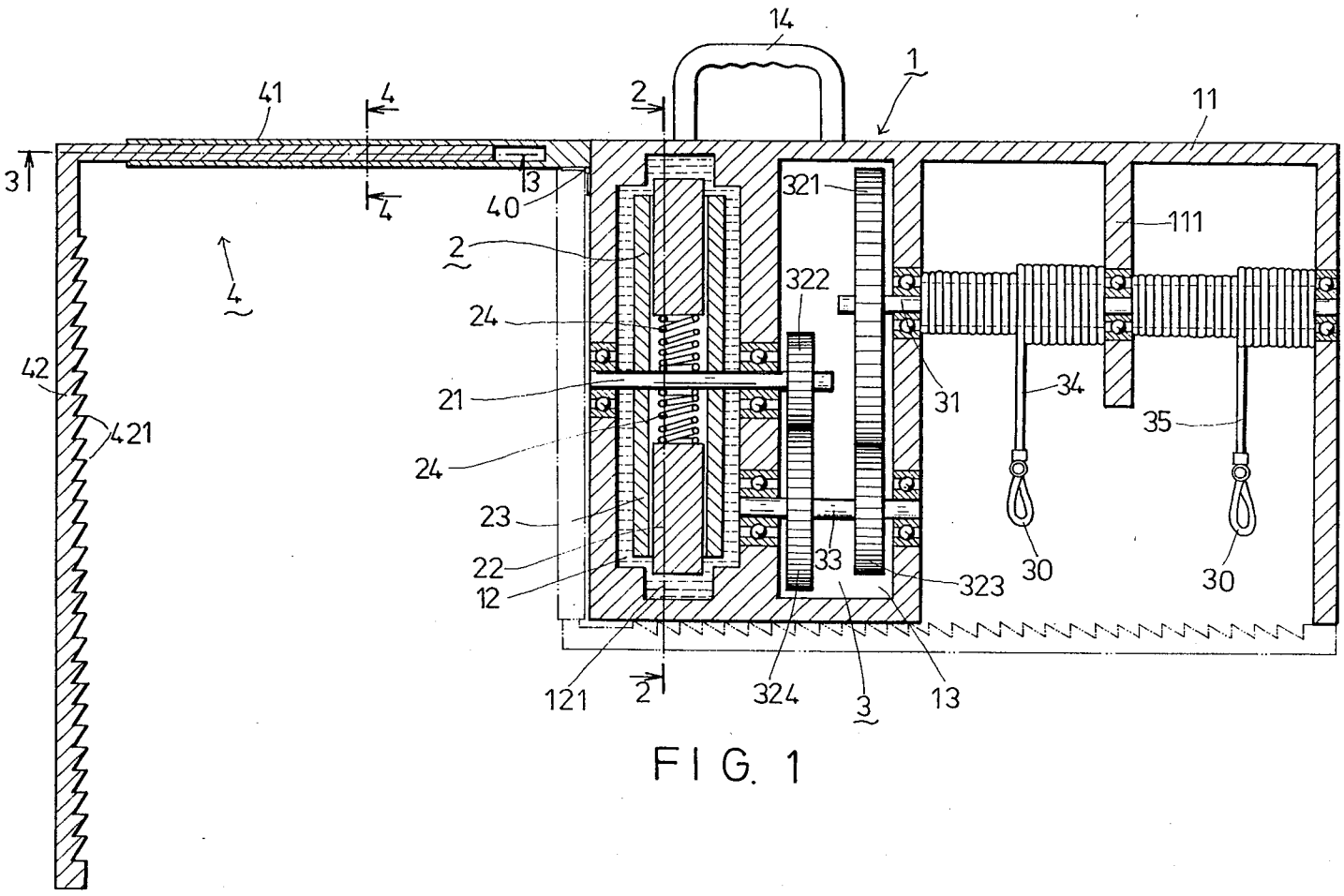
FIG. 1 is a sectioned view of a descent device embodying the present invention.

Referring to FIG. 1, there is shown a body 1, a fluid retarding unit 2, a gear assembly 3 and a mounting means 4. On one side of the body 1 are provided a reversed L-shaped bracket 11 with a dividing plate 111 which is projected from the upper side of the body 1. Inside the body 1 are provided two chambers 12 and 13.

The fluid retarding unit 2 includes a driven shaft 21 mounted on the chamber 12. One end of the shaft 21 is extended into the chamber 13 and on the portion of the shaft 21 which is within the chamber 12 is mounted three vane shells 23 for housing three vane cores 22 respectively. The rear ends of the vane cores 22 are connected to the shaft 21 by means of three springs 24 which have their ends affixed to the shaft 21 and to the rear ends of the vane cores 22 respectively. As such, the vane cores 22 can be extended outwardly of the vane shell 23 by a centrifugal force and then retracted into the vane shell 23 when the centrifugal force disappears.

There are further provided an annular groove 121 in the wall of the chamber 12 into which the vane cores 22 will be extended when the shaft 21 is rotated. The chamber 12 is filled with a fluid such as brake oil, lubricating oil etc.

There is further provided a shaft 31 having its ends journalled in the bracket 11 and in a wall of the body 1 with bearing assemblies. The intermediate portion of the shaft 31 is passed through a bearing assembly provided in the dividing plate 111. Two cables 34 and 35 are separately wound on the spools mounted on the shaft 31 on two sides of the dividing plate 11. The two cables 34 and 35 are wound in opposite directions, so that while the cable 34 is wound up, the cable 35 will be unwound.

The gear assembly 3 includes gears 321, 322, 323 and 324 which are disposed in the chamber 13. The gear 321 is mounted on the shaft 31 and the gear 322 is mounted on the shaft 21. These gears 321 and 322 are meshed with the gears 323 and 324 respectively which are mounted on the shaft 33 provided in the chamber 13. The gear assembly 3 is so arranged that it will transmit the rotating motion of the shaft 31 to the shaft 21 with a high speed ratio.

Figure 2:
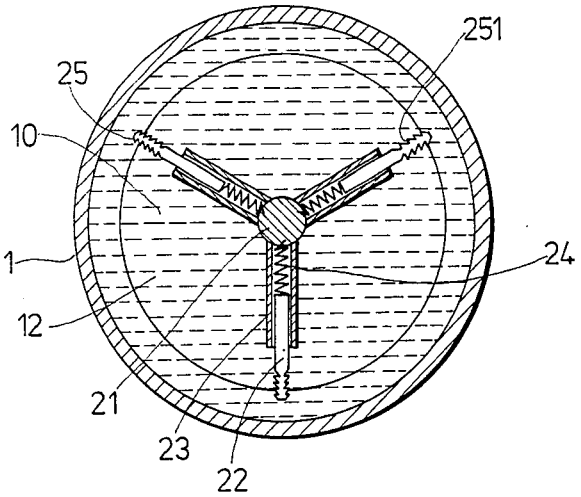
FIG. 2 is a sectioned view taken along the line 2—2 of FIG. 1.

As shown in FIGS. 1 and 2, the vane shells 23 are immersed in the fluid 10 and the fore end of the vane cores 22 are normally retracted in the vane shells due to the springs 24. The fore end of the vane cores 22 are tapered and are provided with rearwardly inclined teeth 25. Because of the presence of the teeth 25, the pressure of the fluid on the fore ends of the vane cores 22 that causes the vane cores 22 to retract in the vane shells 23 will interact with the pressure of the fluid on the radially extending surfaces 251 of the teeth 25, thereby eliminating the tendency of the vane cores 22 to enter into the vane shells 23 during rotation.

When the shaft 21 is rotated due to the weight of the load or a person held by the cable 34 or 35, the vane shells 23 as well as the vane cores 22 will rotate. The rotating speed of the vane shells 23 and vane cores 22 is relatively higher than that of the spools of the cables 34 and 35 because of the gear assembly 3. During rotation, the vane cores 22 are extended outward in part from the vane shells 23 into the annular recess 121 by centrifugal force, thereby increasing the contact surfaces between the vane members constituted of the vane shells 23 and vane cores 22 and the fluid 10 as well as the retarding force of the fluid on the vane members. It can be appreciated that the increase in the contact surfaces depends on the centrifugal force or the weight of the load and will cause the increase in the retarding force. If the weight of the load is increased, the retarding force will be increased. When the weight of the load is reduced, the retarding force will coresspondingly decrease. Therefore, the fluid rotation-retarding means of this type is self-adjustable.

Referring again to FIG. 1, the mounting means 4 is in the form of a hook by which the descent device can be hooked on any structure having a vertically extending wall, for instance, the wall structure below a window. The mounting means 4 is comprised of a hollow member 41 and a reversed L-shaped member 42. The hollow member 41 is attached to the body 1 by means of a hinge 40 and is provided with a bore 411 which can receive one end of the L-shaped member 42. The vertically extending portion of the L-shaped member 42 is provided with a plurality of inclined teeth so as to ensure an effective engagement with the adjacent surface of the support structure on which the descent device is mounted. When the present device is not in use, it can be put into a compact position by turning the hollow member 41 downward so that the vertical portion of the L-shaped member 42 is turned to below the body 1 as shown by the dotted line. The device can be carried easily by means of a handle 14 provided at the top side of the body 1.

Figure 4:
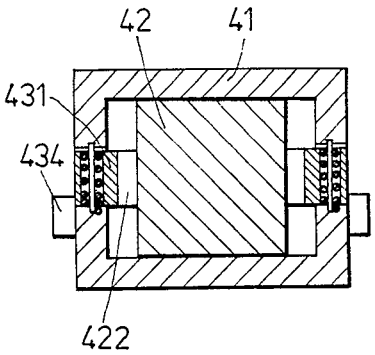
FIG. 4 is a sectioned view taken along the line 4—4 of FIG. 1.
Figure 3:
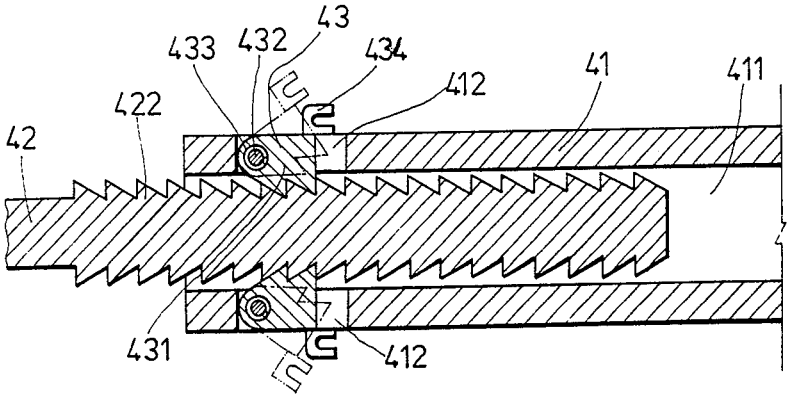
FIG. 3 is a sectioned view taken along the line 3—3 of FIG. 1.

As shown in FIGS. 3 and 4, the horizontal portion of the member 42 which is received in the bore 411 of the hollow member 41 is provided with inclined teeth 422. The member 42 is extensible from and retractable into the hollow member 41 so that the mounting means 4 can be adjusted to suit the support structure of any wall thickness. To secure the member 42 to the member 41, there are further provided two opposite slots 412 in the member 41 in which are pivoted catch members 43 respectively by means of pins 432. A torsion spring 433 is sleeved onto each pin 431 and has its one end secured to the member 41 and its other end secured to the catch member 43. The spring 433 biasses the catch member 43 so as to cause the teeth 431 thereof to engage with the inclined teeth 422. It can be appreciated that the catch member 43 can prevent the outward movement of the member 42 from the bore 411. In the case that the member 42 is to be extended outward, the catch members 43 are moved apart from the teeth 422 by pulling the guide plate 434 of the catch members 43.

At the ends of the cables 34 and 35 are ring members 30 which are used to encircle the body of a person under his arms. Since the cables 34 and 35 are wound on the spools in opposite directions, when a load or a person is lowered by one cable, another cable is wound up for the next lowering.

With the invention thus explained, it is apparent that various modifications and variations can be made without departing from the scope of the invention. It is therefore intended that the invention be limited as indicated in the appended claims.

I claim:

1. An emergency descent device comprising a rotating spool on which is wound a cable to hold a person or a load, and a rotation-retarding means for controlling the rotation of the spool, said retarding means including a fluid-filled chamber, a plurality of vane members mounted for rotation in said chamber, each of said vane members having a vane shell receiving a vane core which is normally biassed in a radially inward direction, said vane core capable of extending outward from said vane shell by a centrifugal force to provide more vane surface to act on the fluid, and a gear assembly which transmits the motion of said spool to said vane members with a high speed ratio.

2. A descent device as claimed in claim 1, wherein the foremost end of said vane core is provided with a plurality of rearwardly inclined teeth.

3. A descent device as claimed in claim 1, further comprising a mounting means which is in the form of a hook, said means including a horizontal portion and a vertically, downwardly extending portion, said horizontal portion being extensible and said vertically extending portion being provided with engaging teeth.

4. A descent device as claimed in claim 1, further comprising a mounting means which is constituted of a horizontal hollow member and a reversed L-shaped member having its one end movably inserted in said hollow member, said one end being provided with inclined teeth and said hollow member being provided with a catch member having catching teeth to be engaged with said inclined teeth for locking said end against movement relative to said hollow member.

* * * * *